US007463840B2

(12) United States Patent
Kim et al.

(10) Patent No.: US 7,463,840 B2
(45) Date of Patent: Dec. 9, 2008

(54) ELECTRO-PHOTOGRAPHIC IMAGE FORMING APPARATUS AND METHOD FOR DETERMINING A CHARGING VOLTAGE

(75) Inventors: Jin-Cheol Kim, Suwon-si (KR); Joong-gwang Shi, Seongnam-si (KR); Yoo-seok Yang, Yongin-si (KR)

(73) Assignee: Samsung Electronics Co., Ltd., Suwon-si (KR)

( * ) Notice: Subject to any disclaimer, the term of this patent is extended or adjusted under 35 U.S.C. 154(b) by 360 days.

(21) Appl. No.: 11/443,025

(22) Filed: May 31, 2006

(65) Prior Publication Data

US 2007/0077079 A1 Apr. 5, 2007

(30) Foreign Application Priority Data

Sep. 30, 2005 (KR) ..... 10-2005-0092349

(51) Int. Cl.
*G03G 15/02* (2006.01)
*G03G 15/00* (2006.01)

(52) U.S. Cl. ..... 399/50; 399/44; 399/176

(58) Field of Classification Search ..... 399/50, 399/176, 168, 313, 44
See application file for complete search history.

(56) References Cited

U.S. PATENT DOCUMENTS 5,450,180 A * 9/1995 Ohzeki et al. ..... 399/50

FOREIGN PATENT DOCUMENTS

| | | |
|---|---|---|
| JP | 06-161294 | 6/1994 |
| KR | 1999-083280 | 11/1999 |
| KR | 1020000014941 | 3/2000 |
| KR | 1020010038693 | 5/2001 |

* cited by examiner

*Primary Examiner*—Susan S Lee
(74) *Attorney, Agent, or Firm*—Royalance, Abrams, Berdo & Goodman L.L.P.

(57) ABSTRACT

Provided is an electro-photographic image forming apparatus and a method of determining a charging voltage thereof. The electro-photographic image forming apparatus includes: a charge roller for supplying a voltage of a predetermined level to a photoconductor; a transfer roller for transferring a developed image to a printing media by using a developer; a high voltage power supply for supplying a charging voltage at a preset level and a transfer voltage at a preset level to the charge roller and the transfer roller, respectively; and a controller for predicting a charged electric potential deviation based on the transfer voltage to be supplied by the high voltage power supply and for determining a charging voltage level to correct for the predicted charged electric potential deviation. Therefore, the deviation of the charged electric potential caused by the transfer voltage is prevented.

10 Claims, 6 Drawing Sheets

ELECTRO-PHOTOGRAPHIC IMAGE FORMING APPARATUS AND METHOD FOR DETERMINING A CHARGING VOLTAGE

CROSS-REFERENCE TO RELATED APPLICATIONS

This application claims the benefit under 35 U.S.C. § 119 (a) of Korean Patent Application No. 2005-92349, filed on Sep. 30, 2005, in the Korean Intellectual Property Office, the entire disclosure of which is hereby incorporated by reference.

BACKGROUND OF THE INVENTION

1. Field of the Invention

The present invention relates to an electro-photographic image forming apparatus and a method of determining a charging voltage. More particularly, the present invention relates to an electro-photographic image forming apparatus for determining a proper charging voltage to correct for deviations in a charged electric potential based on a transfer voltage supplied at a transfer roller, and a method thereof.

2. Description of the Related Art

A conventional image forming apparatus, such as a laser beam printer and LED print head printer (LPH), utilizes electro-photographic technology. Electro-photographic image forming apparatuses perform image forming operations by the processes of charging, scanning, developing, transferring and fixing.

The conventional electro-photographic image forming apparatus includes a photoconductive drum, a charge roller, a laser scanning unit (LSU), a developer roller, a transfer roller and a high voltage power supply (HVPS).

A first step of forming an image using the electro-photographic image forming apparatus is a charging process. In the charging process, a constant charged electric potential must be stably maintained in order to achieve uniformity of the image.

More specifically, if a surface electric potential on a photoconductive drum is unstably maintained while performing a printing operation, images recorded on a recording printing media have an inconstant concentration, thereby resulting in the images having degraded quality. Therefore, it is very important to supply a constant charging voltage to a charge roller in order to uniformly maintain a surface electric potential on a photoconductive drum.

Although a constant charging voltage is supplied to the charge roller, the charged electric potential varies according to the transfer voltage supplied to the transfer roller.

Accordingly, there is a need for an improved method of correcting for the deviation of charged electric potential due to the transfer voltage in the electro-photographic image forming apparatus, and an apparatus employing the method.

SUMMARY OF THE INVENTION

Exemplary embodiments of the present invention address at least the above problems and/or disadvantages and provide at least the advantages described below. Accordingly, an aspect of the present invention is to provide an electro-photographic image forming apparatus estimating a charged electric potential deviation caused by a transfer voltage, corresponding to each of a plurality of printing environments and controlling a charging voltage to correct for the estimated charged electric potential deviation, and a method of determining the charging voltage thereof.

In accordance with an aspect of an exemplary embodiment of the present invention, there is provided an electro-photographic image forming apparatus including a charge roller for supplying a voltage of a predetermined level to a photoconductor; a transfer roller for transferring a developed image to a printing media by using a developer; a high voltage power supply for supplying a charging voltage at a preset level and a transfer voltage at a preset level to the charge roller and the transfer roller, respectively; and a controller for predicting a charged electric potential deviation based on the transfer voltage to be supplied by the high voltage power supply and for determining a charging voltage level to correct for the predicted charged electric potential deviation.

The electro-photographic image forming apparatus may further include a storing unit for storing a table comprising charged electric potential deviations caused by the transfer voltage according to each of a plurality of printing environments; and an environment recognizing unit for recognizing a current printing environment of the plurality of printing environments.

The controller may obtain an estimated electric potential deviation according to the transfer voltage from the table for the recognized current printing environment, and determines the charging voltage level to correct for the obtained estimated charged electric potential deviation.

The plurality of printing environments may include a low temperature and low humidity environment, a normal temperature and normal humidity environment and a high temperature and high humidity environment.

In accordance with another aspect of an exemplary embodiment of the present invention, there is provided a method of determining a level of a charging voltage of an electro-photographic image forming apparatus including estimating a charged electric potential deviation based on a transfer voltage to be supplied to a transfer roller; and determining a level of a charging voltage to be supplied to a charge roller so as to correct for the estimated charged electric potential deviation.

The method may further include recognizing a current printing environment of a plurality of printing environments.

In the estimating of the deviation, an estimated charged electric potential deviation, according to the transfer voltage, is obtained from a pre-stored table corresponding to the recognized current printing environment, wherein the pre-stored table comprises charged electric potential deviations according to a transfer voltage corresponding to the plurality of printing environments.

The plurality of printing environments may include a low temperature and low humidity environment, a normal temperature and normal humidity environment and a high temperature and high humidity environment.

Other objects, advantages, and salient features of the invention will become apparent to those skilled in the art from the following detailed description, which, taken in conjunction with the annexed drawings, discloses exemplary embodiments of the invention.

BRIEF DESCRIPTION OF THE DRAWINGS

The above and other objects, features, and advantages of certain embodiments of the present invention will be more apparent from the following description taken in conjunction with the accompanying drawings, in which.

Throughout the drawings, the same drawing reference numerals will be understood to refer to the same elements, features, and structures.

DETAILED DESCRIPTION OF EXEMPLARY EMBODIMENTS

The matters defined in the description such as a detailed construction and elements are provided to assist in a comprehensive understanding of the embodiments of the invention and are merely exemplary. Accordingly, those of ordinary skill in the art will recognize that various changes and modifications of the embodiments described herein can be made without departing from the scope and spirit of the invention. Also, descriptions of well-known functions and constructions are omitted for clarity and conciseness.

Figure 1:
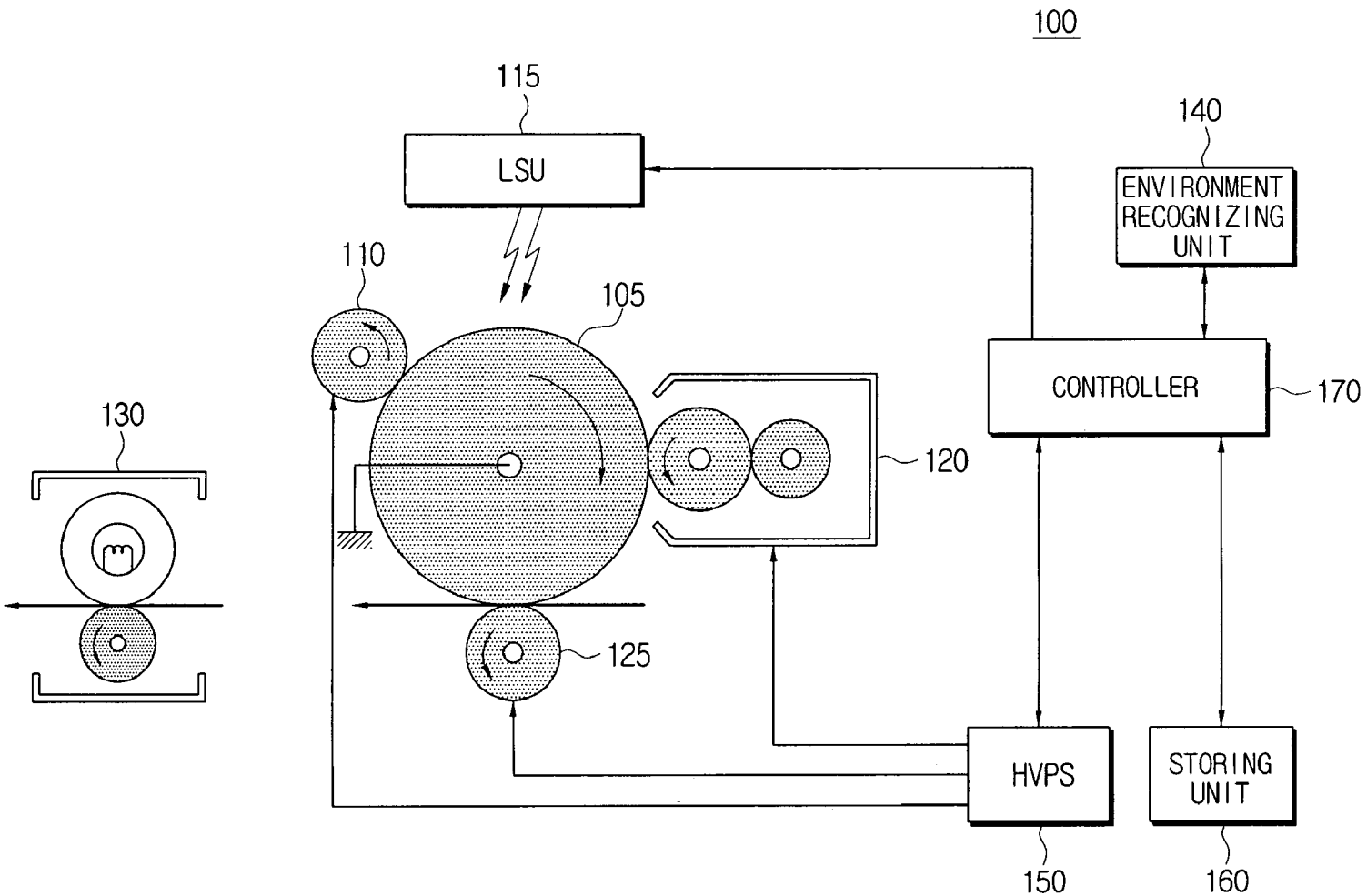
FIG. 1 is a schematic view of an electro-photographic image forming apparatus according to an exemplary embodiment of the present invention.

FIG. 1 is a schematic view of an electro-photographic image forming apparatus according to an exemplary embodiment of the present invention.

Referring to FIG. 1, the electro-photographic image forming apparatus 100 includes a photoconductive drum 105, a charge roller 110, a laser scanning unit (LSU) 115, a developing unit 120, a transfer roller 125, a fuser 130, an environment recognizing unit 140, a high voltage power supply (HVPS) 150, a storing unit 160 and a controller 170.

The photoconductive drum 105 is an organic photoconductive drum on which an electrostatic latent image is formed by emitting light from the LSU 115.

The charge roller 110 charges the photoconductive drum 105 using a charging voltage of a predetermined level supplied from the HVPS 150. Herein, the controller 170 predicts a deviation of the charged electric potential and controls the charge roller to supply the charging voltage according to the predicted deviation of the charged electric potential.

The LSU 115 radiates light onto the photoconductive drum 105 according to printing data in response to the controller 170. That is, the LSU 115 forms an electrostatic latent image on the photoconductive drum 105 by radiating the light onto the photoconductive drum 105.

The developing unit 120 includes a developer roller and a supplying roller. The developing unit 120 develops the electrostatic latent image formed on the photoconductive drum using a developer, such as toner. That is, toner is transferred from the supply roller to the developer roller because of a difference in electric potential between the supply roller receiving a predetermined level of supply voltage and the developer roller receiving the developing voltage. As a result, a toner image is formed on the photoconductive drum 105 by developing the electrostatic latent image with toner.

The transfer roller 125 helps transfers the toner image from the photoconductive drum 105 to a printing media by using the transfer voltage supplied from the HVPS 150 while rotating the transfer roller 125 with the photoconductive drum 105.

The fuser 130 includes a fuse roller and a pressure roller. The fuser 130 fixes the transferred toner image on the printing media by heating and pressurizing the transferred toner image to the printing media. After fixing the toner image on the printing media, the printing media is outputted along an output direction.

The environment recognizing unit 140 recognizes which of a plurality of printing environments the electro-photographic image forming apparatus 100 is in. Examples of environments recognized by the environment recognizing unit 140 includes a low temperature and low humidity environment (LL), a normal temperature and normal humidity environment (NN) and a high temperature and high humidity environment (HH). An exemplary environment recognizing unit 140 is a conventional temperature sensor and/or conventional humidity sensor.

The HVPS 150 supplies a voltage of a predetermined level to each of the rollers in response to the controller 170. That is, the HVPS 150 supplies the charging voltage, the developing voltage, the supply voltage and the transfer voltage to the charge roller 100, the developer roller, the supply roller and the transfer roller 125, respectively. Conventionally, a high voltage power supply supplies a charging voltage of a fixed level, supply voltage and transfer voltage to corresponding rollers. However, the controller 170 determines the level of the charging voltage based on the estimated deviation of the charged electric potential, according to an exemplary embodiment of the present embodiment.

The storing unit 160 stores various control programs for performing functions of the electro-photographic image forming apparatus 100 and data generated while performing the control programs.

Also, the storing unit 160 stores tables containing information about a decreased charged electric potential per given environment that is caused by the transfer voltage in the given environment. Since the low temperature and low humidity environment (LL), the normal temperature and normal humidity environment (NN) and the high temperature and high humidity environment (HH) are used as examples of printing environments in the present embodiment, the table stores information on the decreased levels of charged electric potential that is caused by to the transfer voltage in each of the three printing environments LL, NN and HH. An exemplary table will be described in detail with reference to FIG. 2 and FIGS. 3A through 3C.

The controller 170 controls general operations of the electro-photographic image forming apparatus 100 by running a control program stored in the storing unit 160. The controller 170 controls the HVPS 150 so as to supply a proper voltage level to each of the rollers.

In the present embodiment, the controller 170 estimates a deviation in the charged electric potential based on the transfer voltage to be supplied to the transfer roller 125 through the HVPS 150. The controller 170 further determines a level of the charging voltage to be supplied to the charge roller 110 in order to correct for the estimated deviation in the charged electric potential.

In other words, the controller 170 analyzes a current printing environment through the environment recognizing unit 140. Further, the controller 170 estimates the deviation of the charged electric potential according to the predetermined level of the transfer voltage to be supplied to the transfer roller 125 based on the table stored in the storing unit 160 and the result of the analysis.

Figure 2:
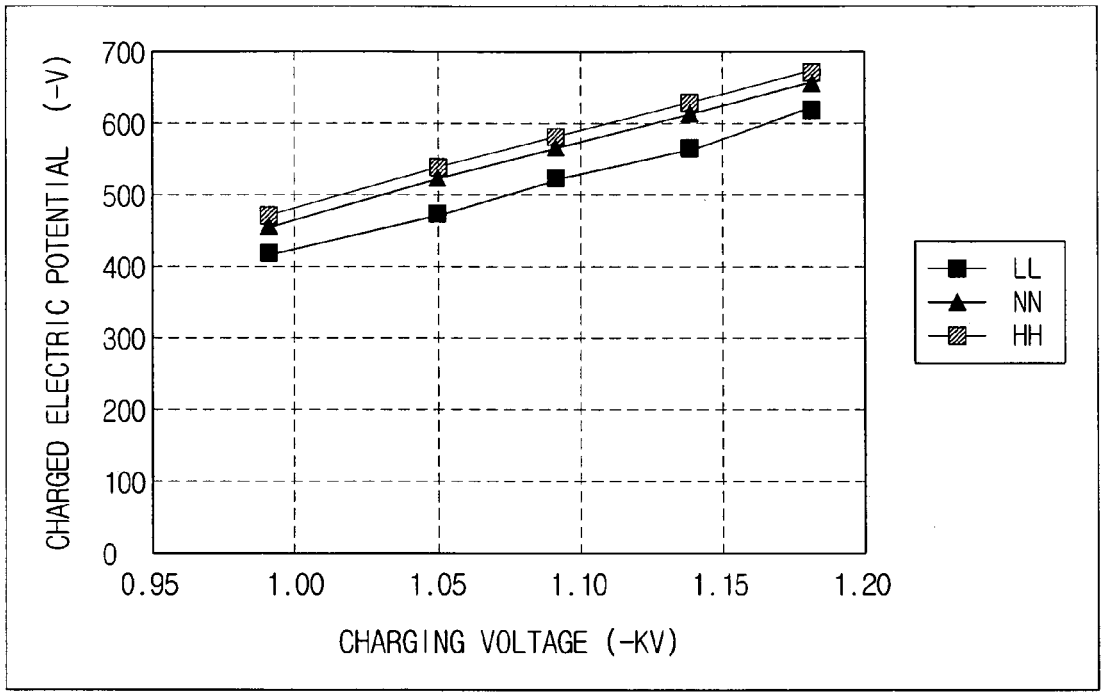
FIG. 2 is a graph for describing a deviation of charged electric potential and a charging voltage according to printing environments.

FIG. 2 is a graph showing a deviation in the charging voltage and charged electric potential according to the printing environment.

A characteristic curve according to a charging voltage shown in the graph of FIG. 2 is obtained by supplying the different levels of charging voltage to the charge roller 110 according to each of the printing environments, such as low temperature and low humidity LL, normal temperature and normal humidity NN and high temperature and high humidity HH, and measuring the charged electric potential formed according to the levels of the charging voltage.

As shown, there is a linear relationship between the charging voltage and the charged electric potential for each of the printing environments. That is, the deviation in the charged electric potential can be corrected by supplying the charging voltage to the charge roller 110 at a level that is higher by an amount equal to as much as the predicted deviation of the charged electric potential.

For example, if the controller 170 predicts that there will be a decrease of 40V of charged electric potential, the controller 170 increases the level of the charging voltage by as much as 40V to correct for the 40V decrease of the charged electric potential because the charging voltage and the charged electric potential have a linear relationship.

Table 1 shows an exemplary relationship between the charging voltage and the charged electric potential and a deviation between the charged electric potential for each of the exemplary printing environments, which are shown in the graph of FIG. 2. The controller 170 varies the level of the charge voltage by controlling a pulse width modulation (PWM) duty cycle with reference to the stored table, such as Table 1.

TABLE 1

| APP (−kV) | PWM DUTY | LL | NN | HH |
|---|---|---|---|---|
| 0.99 | 128 | 419 | 460 | 470 |
| 1.05 | 132 | 479 | 520 | 529 |
| 1.09 | 135 | 521 | 564 | 572 |
| 1.14 | 138 | 567 | 607 | 618 |
| 1.18 | 141 | 610 | 650 | 659 |

Figure 3A:
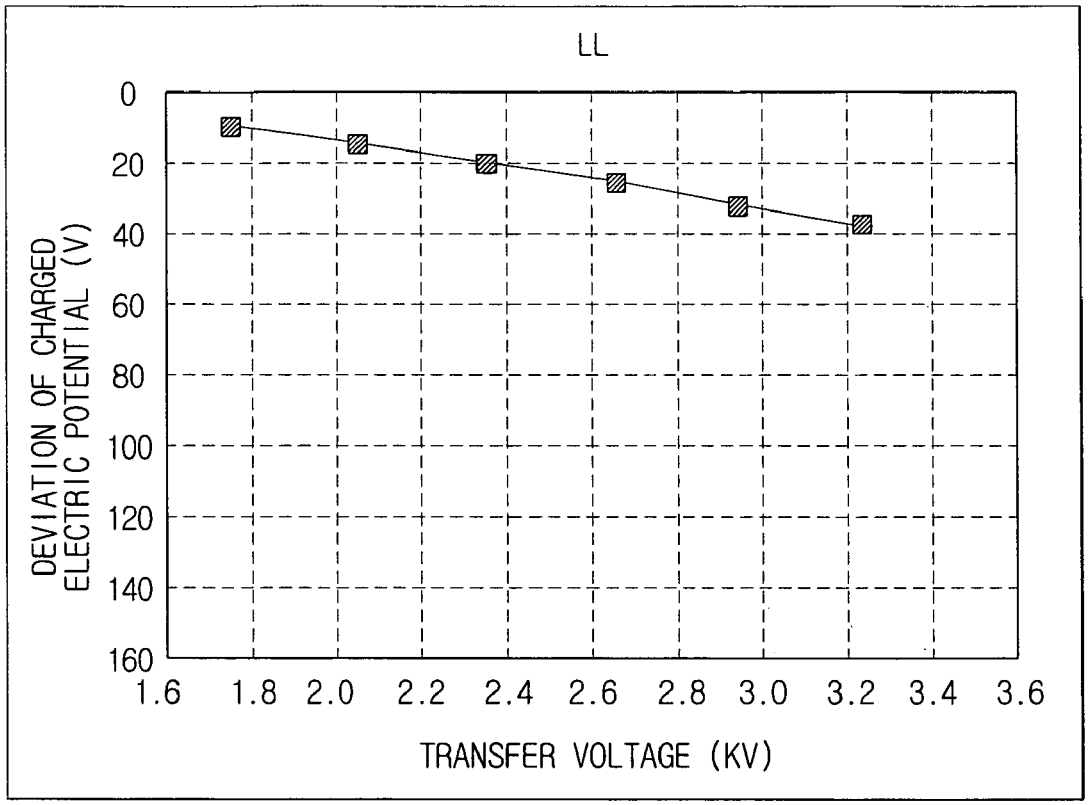
FIGS. 3A through 3C are graphs for describing deviations of charged electric potential caused by a transfer voltage according to printing environments.
Figure 3B:
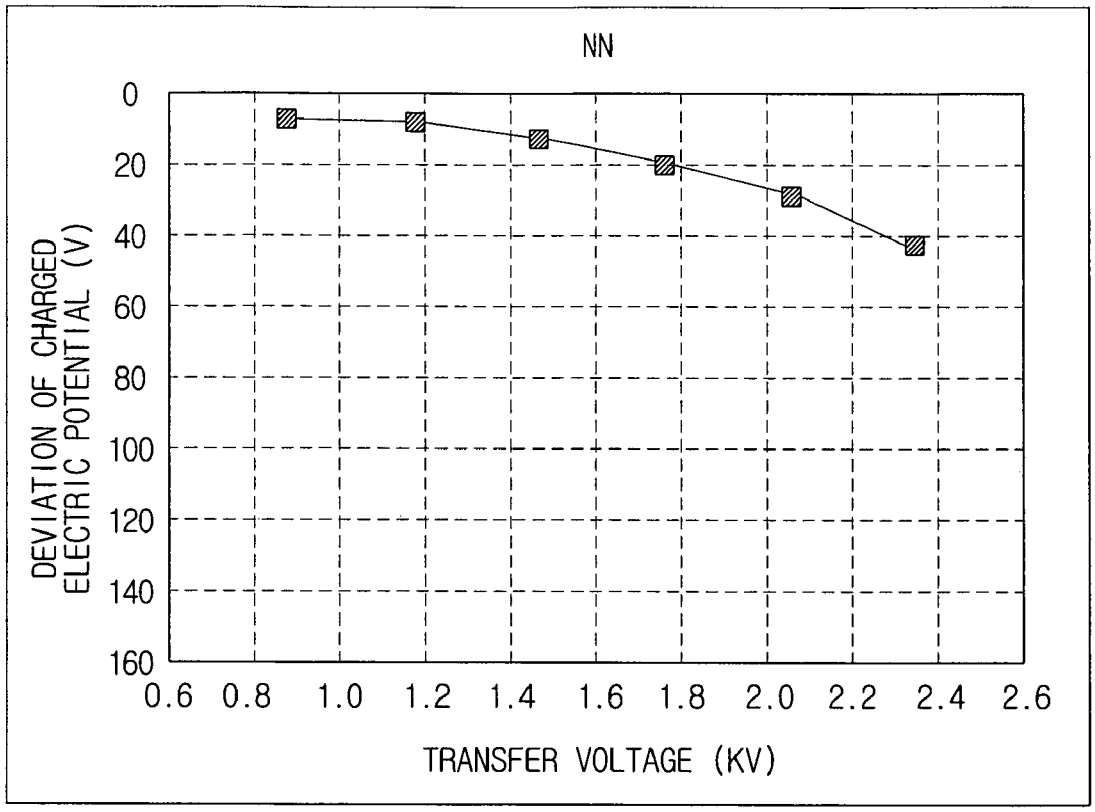
Figure 3C:
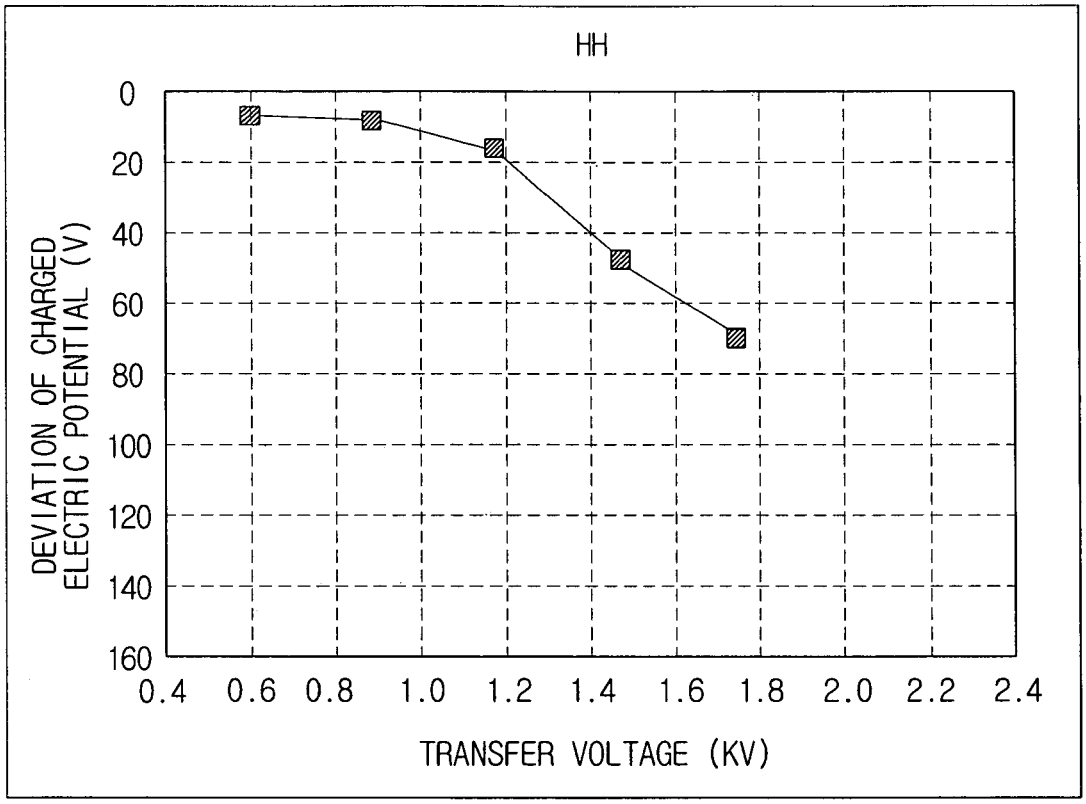

FIGS. 3A through 3C are graphs showing a deviation of the charged electric potential for a given transfer voltage for each of the printing environments.

FIGS. 3A through 3C show decreased charged electric potential on the photoconductive drum 105 when the transfer voltage is changed according to each printing environment recognized by the environment recognizing unit 140.

FIG. 3A shows that the decrease of the charged electric potential varies according to the transfer voltage when the recognized printing environment is the LL environment. FIG. 3B shows that the decrease of the charged electric potential varies according to the transfer voltage when the recognized printing environment is the NN environment, and FIG. 3C shows that the decrease of the charged electric potential varies according to the transfer voltage when the recognized printing environment is the HH environment.

The graphs shown in FIGS. 3A through 3C are quantified as a table and the table is stored in the storing unit 160. Accordingly, the controller 170 can determine the charging voltage to be supplied to the charge roller 110 based on the table stored in the storing unit 160.

For example, if the environment recognizing unit 140 recognizes the current printing environment as the HH environment and the transfer voltage to be supplied to the transfer roller 125 is 1400V, the controller 170 estimates that the deviation of the charged electric potential is 40V which is shown in FIG. 3C for the HH printing environment. Based on the estimation, the controller determines to increase the charging voltage by as much as 40V so as to correct for the charged electric potential deviation. In addition the controller determines that the PWM DUTY 3 is required in order to increase the charging voltage by 40V.

Figure 4:
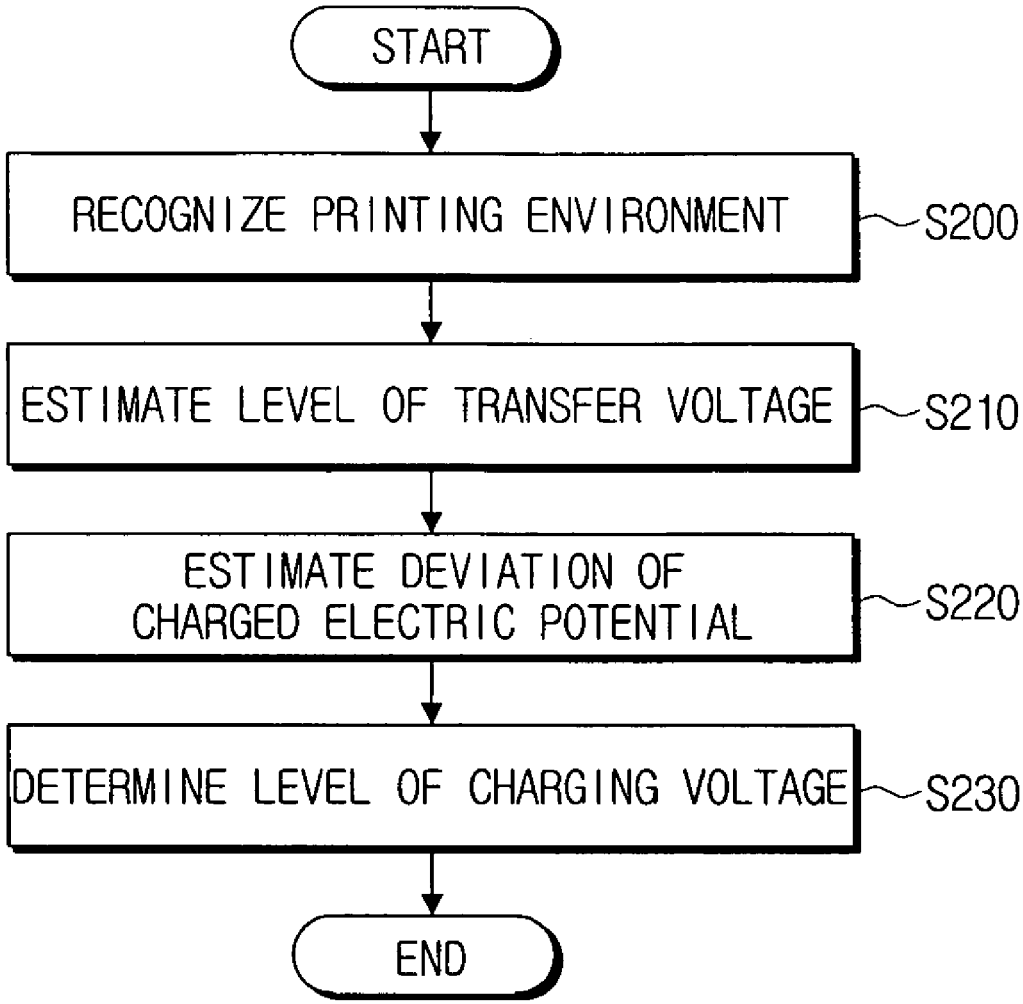
FIG. 4 is a flowchart of a method of determining a charging voltage of an electro-photographic image forming apparatus according to an exemplary embodiment of the present invention.

FIG. 4 is a flowchart of a method of determining a charging voltage in an electro-photographic image forming apparatus according to an exemplary embodiment of the present invention.

Hereinafter, the method of determining a charging voltage in an electro-photographic image forming apparatus according to an exemplary embodiment of the present invention will be described with reference to FIGS. 1 through 4 in detail.

In order to prevent the charged electric potential from being varied by the transfer voltage, the electro photographic image forming apparatus 100 recognizes a current printing environment using the environment recognizing unit 140 before performing a printing operation in operation S200.

After recognizing the current printing environment by the environment recognizing unit 140, the controller 170 determines a level of the transfer voltage to be supplied to the transfer roller 125 through the HVPS 150, in operation S210. Herein the level of the transfer voltage to be supplied to the transfer roller 125 may be a predetermined level.

The controller 170 obtains an estimated deviation of charged electric potential according to the transfer voltage from the table corresponding to the current printing environment in operation S220.

The controller 170 determines a level of the charging voltage to correct the estimated deviation according to the obtained deviation of the charged electric potential and determines the level of the charging voltage to be supplied to the charge roller 110 in operation S230.

After determining the level of the charging voltage according to the transfer voltage to be supplied to the transfer roller 125, the controller 170 controls the HVPS 150 to supply the corresponding levels of voltage to each of the rollers. Herein, the charge roller 110 receives the determined level of charging voltage according to the estimated deviation of the charge electric potential. However, the transfer roller 125, the developer roller and the supply roller receive the pre-set levels of transfer voltage, develop voltage and supply voltage, respectively.

As described above, the electro-photographic image forming apparatus and the method of determining the charging voltage thereof according to an exemplary embodiment of the present invention estimates the deviation of the charged electric potential caused by the transfer voltage corresponding to the printing environments and controls the level of the charging voltage to correct for the estimated deviation of the predicted charged electric potential. Therefore, the distortion of the charged electric potential caused by the transfer voltage is prevented without requiring an additional sensor such as an electric potential detecting sensor. Also, charging voltage can be uniformly maintained and the characteristics of the photoconductive drum can be maintained.

While the invention has been shown and described with reference to certain embodiments thereof, it will be understood by those skilled in the art that various changes in form and details may be made therein without departing from the spirit and scope of the invention as defined by the appended claims. The present teaching can be readily applied to other types of apparatuses.

What is claimed is:

1. An electro-photographic image forming apparatus comprising:

a charge roller for supplying a voltage of a predetermined level to a photoconductor;

a transfer roller for transferring a developed image to a printing media by using a developer on the photoconductor;

a high voltage power supply for supplying a charging voltage level and a transfer voltage to the charge roller and the transfer roller, respectively; and a controller for predicting a charged electric potential deviation based on the transfer voltage to be supplied by the high voltage power supply and for determining a charging voltage level to correct for the predicted charged electric potential deviation.

2. The electro-photographic image forming apparatus of claim 1, further comprising:

a storing unit for storing a table comprising charged electric potential deviations caused by the transfer voltage according to each of a plurality of printing environments; and an environment recognizing unit for recognizing a current printing environment of the plurality of printing environments.

3. The electro-photographic image forming apparatus of claim 2, wherein the controller obtains an estimated electric potential deviation according to the transfer voltage from the table for the recognized current printing environment, and determines the charging voltage level to correct for the obtained estimated charged electric potential deviation.

4. The electro-photographic image forming apparatus of claim 2, wherein the plurality of printing environments comprises a low temperature and low humidity environment, a normal temperature and normal humidity environment and a high temperature and high humidity environment.

5. The electro-photographic image forming apparatus of claim 1, wherein the charged electric potential deviation is a charged electric potential decrement.

6. A method of determining a level of a charging voltage of an electro-photographic image forming apparatus comprising:

estimating a charged electric potential deviation based on a transfer voltage to be supplied to a transfer roller; and determining a level of a charging voltage to be supplied to a charge roller so as to correct for the estimated charged electric potential deviation.

7. The method of claim 6, further comprising:

recognizing a current printing environment of a plurality of printing environments.

8. The method of claim 7, wherein in the estimating of the deviation, an estimated charged electric potential deviation, according to the transfer voltage, is obtained from a pre-stored table corresponding to a recognized current printing environment, wherein the pre-stored table comprises charged electric potential deviations according to a transfer voltage corresponding to a plurality of printing environments.

9. The method of claim 7, wherein the plurality of printing environments comprise a low temperature and low humidity environment, a normal temperature and normal humidity environment and a high temperature and high humidity environment.

10. The method of claim 6, wherein the charged electric potential deviation is a charged electric potential decrement.

* * * * *